US005797546A

United States Patent [19]

Reed et al.

[11] Patent Number: 5,797,546

[45] Date of Patent: Aug. 25, 1998

[54] WEIGHT-SUPPORTED ADJUSTABLE MIXING AND DISPENSING GUN FOR TWO CHEMICALLY REACTIVE MATERIALS

[75] Inventors: Jeffrey S. Reed, Alexandria, Ky.; Richard L. Frazier, Williamsburg, Ohio

[73] Assignee: Morton International, Inc., Chicago, Ill.

[21] Appl. No.: 739,696

[22] Filed: Oct. 29, 1996

[51] Int. Cl.[6] ..... B05B 7/04

[52] U.S. Cl. ..... 239/280.5; 239/304; 239/432; 239/530; 239/587.5; 239/588; 248/317; 248/323

[58] Field of Search ..... 239/587.5, 588, 239/280, 432, 304, 526, 530, 208, 209, 282, 283, 280.5; 285/181; 248/147.3, 328, 323, 317

[56] References Cited

U.S. PATENT DOCUMENTS

| | | | |
|---|---|---|---|
| 332,515 | 7/1885 | Young | 248/329 |
| 2,145,142 | 1/1939 | Stout | 248/328 X |
| 2,176,979 | 10/1939 | Plafz | 248/328 |
| 2,775,481 | 12/1956 | Mitchell | 239/209 |
| 3,164,307 | 1/1965 | Hrdina | 222/527 |
| 3,265,087 | 8/1966 | Livingston | 239/209 X |
| 3,729,092 | 4/1973 | Marcell | 248/317 X |
| 3,790,030 | 2/1974 | Ives | 239/432 X |
| 4,262,847 | 4/1981 | Stitzer et al. | 239/432 X |
| 4,643,336 | 2/1987 | Mandeville et al. | 222/145 |
| 4,771,919 | 9/1988 | Ernst | 222/134 |
| 4,834,293 | 5/1989 | Lichfield | 239/526 X |
| 4,846,373 | 7/1989 | Penn et al. | 222/137 |
| 4,869,400 | 9/1989 | Jacobs | 222/137 |
| 4,936,511 | 6/1990 | Johnson et al. | 239/346 |
| 4,951,843 | 8/1990 | Paetow | 222/145 |
| 5,033,650 | 7/1991 | Colin et al. | 222/137 |
| 5,069,881 | 12/1991 | Clarkin | 422/135 |
| 5,224,629 | 7/1993 | Hsich | 222/137 |

OTHER PUBLICATIONS

Product Brochure, Hydra-Mate Plural Component Sealast and Adhesive Dispensing System, Graco, Inc. (1989).

Product Brochure, Precision Metering, Mixing, Dispensing Systems H & G Industries (Prior Art).

Engineering Drawings, Kit, Gun, Flex Mixer, Graco, Inc. (1990).

Engineering Drawings, Flow Gun Assembly, H & G Industries (Prior Art).

Product Brochure, 2K Ultra-Lite Two Component Dispense Value For Use With Disposable Mixers, Graco Inc., pp. 3–6 (1995).

(List continued on next page.)

*Primary Examiner*—Kevin Weldon
*Attorney, Agent, or Firm*—Steven C. Benjamin; Gerald K. White

[57] ABSTRACT

A mixing and dispensing system for two reactive fluids, such as two-component polysulfide sealants, in which the dispensed fluids are supplied to a hand operated mixing and dispensing gun through a pair of flexible hoses suspended above the floor from a pivotal boom. The flexible hoses are pivotally attached with swivel joints onto the inlets of the gun that are spaced on opposite lateral sides of the gun, and the swivels are rotatable about a common generally horizontal pivot axis. The gun is fully weight supported in an operative position above the floor with a tool balancer attached to the boom. The tool balancer includes an adjustably tensioned and extendable line that is pivotally attached to the top of the gun body and rotatable about a generally vertical pivot axis. The gun passes the two reactive fluids separately through the gun body and mounted on the divided outlet of the gun is a disposable static mixer having a single inlet attached to an elongated spiral mixer tube that terminates in a dispensing outlet nozzle. A hand operated actuating trigger is mounted on the static mixer tube in close proximity to the dispensing outlet nozzle. The mixing and dispensing gun is lighter, generates less waste, and is more maneuverable than prior two component mixing and dispensing guns.

19 Claims, 7 Drawing Sheets

U.S. PATENT DOCUMENTS 5,242,115 9/1993 Brown ..... 239/432 X
5,330,106 7/1994 Braun, Jr. ..... 239/526
5,332,313 7/1994 Cimbalik et al. ..... 366/303
5,333,760 8/1994 Simmen ..... 222/137
5,372,389 12/1994 Tam et al. ..... 285/147.3
5,383,581 1/1995 LeMarbe et al. ..... 222/459
5,388,768 2/1995 Moses ..... 239/417.5
5,405,083 4/1995 Moses ..... 239/9
5,443,183 8/1995 Jacobsen et al. ..... 222/145.6
5,499,745 3/1996 Derian et al. .

WEIGHT-SUPPORTED ADJUSTABLE MIXING AND DISPENSING GUN FOR TWO CHEMICALLY REACTIVE MATERIALS

FIELD OF THE INVENTION

This invention relates to an apparatus for mixing and dispensing two chemically reactive fluids and, more particularly, to an easy-to-use, fully weight-supported in an operative position, and multiply pivoted hand-operated mixing and dispensing gun, especially suited to be used for applying two-component polysulfide sealants to insulating glass units.

BACKGROUND OF THE INVENTION

Two-component fluids, such as reactive sealants or adhesives, are made up of two separate materials, that are initially stored in separate containers, but which when intermixed, react chemically with one another to eventually form the desired hardened sealant or adhesive product. For example, polysulfide sealants that are used in the fabrication of insulating glass units, such as windows and doors, in order to provide seals against moisture intrusion and heat loss, include a first viscous curable polymeric material, such as a polysulfide base resin, and a second viscous material, such as a catalyst or hardener for the base resin. After intermixing, the reactive fluids are often dispensed from a hand-held dispensing gun and applied to the work piece in a bead containing the desired amount of intermixed components.

A variety of systems have been employed for mixing and dispensing two-component reactive fluids. In earlier systems, it is common to pump the two fluids from their individual storage vessels through two flexible hoses, that are supported on an elevated pivoted arm, into a motionless premixer that freely hangs down in air from the pivoted arm. Usually, the flexible hoses are attached by rigid connections, such as with standard fittings, to the inlet of a motionless premixer. The two fluids are then directed through the premixer for homogeneous mixing prior to being dispensed. Next, the mixed components are directed from the premixer outlet to the inlet of a generally unsupported hand-held dispensing gun that freely hangs down from the premixer to the floor. Usually, a single flexible hose rigidly connects the premixer outlet to the dispensing gun inlet. The dispensing gun typically includes a dispensing valve in the body of the gun actuated by a finger trigger on the hand grip of the gun for the operator to control the mixed fluid flow to an outlet nozzle. The hand-held dispensing gun when not in use is usually placed on a hook suspending down from the pivoted arm, so that the gun does not drag on the floor when not in use.

The use of premixers makes these dispensing systems much more complex and cumbersome, and also results in waste in the portion of the fluids left in the premixer or gun after mixing, particularly in instances where the mixed fluids are not immediately dispensed. Since the mixture tends to cure and take a set when brought together, the mixed material that remains in the equipment is not only wasted, but also if not purged quickly from the system with either solvent from a separate line or one of the unmixed components passed alone through the system, it necessitates taking the premixer and gun apart for expensive and time-consuming solvent cleaning to clear the obstructed flow passages. The cleaning solvents or unmixed purged components used to clear the system must also be disposed of as hazardous waste, which leads to increased operating costs.

Moreover, in such earlier systems, the dispensing gun and premixer are too heavy and bulky, and, as a result, movement and positioning of the gun are difficult and cumbersome. Also, the rigidity of the connections established between the flexible hosing and the premixer and dispensing gun adds to the difficulty that the operator experiences in maneuvering the gun. Accordingly, it is necessary for the operator handling the dispensing gun to expend considerable energy in manually supporting and maneuvering the dispensing gun, premixer and attached hoses. As a consequence, the operator commonly experiences fatigue, muscle strain and other physical maladies. Also, the resulting difficulty in properly positioning the dispensing over the work piece gun exactly as desired causes improper or incomplete application of the fluid onto the work piece, adversely affecting the quality of the work product.

In another type of dispensing system that has been proposed, the aforesaid assembly is rearranged such that the motionless mixer is placed at the outlet of the hand-held dispensing gun. In such a system, the two separate fluid components are fed individually to the gun, passed separately through valved ports in the gun that are controlled by the operator actuating the finger trigger on the hand grip of the gun, and finally brought into contact with each other in the static mixer attached to the outlet nozzle of the gun. The static mixer is usually attached to the gun outlet in a removal manner, and is designed to be disposed and replaced after use, in order to avoid the necessity of wasteful and expensive purging and cleaning of any part of the gun which comes into contact with mixed fluid components. The static mixer includes a rather elongated body from which the mixed material is directed to an outlet nozzle at the remote end of the mixer.

One of the problems with such an arrangement is that elongated static mixer body causes the dispensing nozzle to be positioned a great distance away from the actuating trigger located on the hand grip of the gun, which arrangement makes the gun difficult and cumbersome to use. The intricacies of the parts, including channels and grooves, in which the reactive material is to be deposited requires the gun to be positioned with precision over the work piece. Improper positioning during application adversely affects the quality of the work. The dispensing nozzle, however, being positioned so far away from the actuating trigger on the hand grip where the operator holds the gun causes the operator to lose control of the nozzle during application.

Also, the gun body is too heavy, bulky and unbalanced, which tends to force the dispensing nozzle to move out of position, either upwardly or downwardly, during application. The rigidity of the flexible hose connections to the gun adds to the difficulty in maneuverability of the gun. The operator, therefore, has to expend considerable energy to not only manually support and guide the gun and the attached hoses into position, but also once in position, he has to expend a significant amount of additional energy even to maintain the nozzle in the proper position. The extensive manual movement and effort required to support, maneuver and position the gun and attached hoses commonly causes the operator to experience strain and fatigue in this system as well.

U.S. Pat. No. 4,643,336 to Mandeville et al. discloses a mixing and dispensing gun including a hand-held gun body having a hand grip, an actuating trigger on the hand grip, and spaced inlets in the gun for separately receiving two components of a reactive fluid from flexible hoses. The flexible hoses are pivotally suspended from a pivoted arm, yet the hoses are rigidly connected with standard fittings to the gun inlets. A dispensing valve is included in the gun and is actuated by the trigger, and a vertically, rather than horizontally, elongated static mixer is threadedly attached to the gun, with the mixer being interposed between the dispensing valve and outlet nozzle of the gun. The vertically elongated static mixer reduces the overall length of the gun and, consequently, brings the dispensing nozzle and gun closer to the work surface to improve the control of fluid placement during operation, as well as making the gun less cumbersome.

However, the mixing and dispensing gun is not weight supported on the pivoted arm in an operative position and hangs freely down therefrom to the floor. The gun is also rigidly connected to the flexible hoses that deliver the two components into the gun. For the same reasons as previously discussed, the operator using the system of Mandeville et al. must still exert considerable effort to manually support and maneuver the gun and attached hoses into the proper position over the work surface.

U.S. Pat. No. 5,330,106 to Braun, Jr. discloses a hand-held mixing and dispensing gun having the two flexible supply hoses attached to the gun by rotatable swivel connectors to facilitate ease of movement of the gun relative to the flexible hoses. A swivel connector is rotatably mounted on each end portion of a cylindrical distributor that is rigidly attached to the rear of the gun remote from the valved outlet nozzle. The swivel connectors include separate inlets connected to the two supply hose ends, with the swivel inlets also being in communication with separate distributor conduits which, in turn, communicate with the separate conduits attached to the dispensing nozzle of the gun.

Since both hoses are connected to the distributor with the use of swivels rotatable about a common axis, improved flexibility between the gun and hoses is achieved, and pivoting the dispenser gun relative to the hoses is said to require less effort. Furthermore, the swivel connections between the hoses and gun are said to reduce the hose weight imposed on the dispenser gun. In another embodiment of Braun, Jr., the distributor is rotatably connected to the gun having a pivot axis perpendicularly disposed to the common hose swivel axis. The distributor in this arrangement may itself swivel relative to the gun, which is said to further enhance the flexibility and allow three dimensional adjustment of the gun.

In Braun, Jr., however, the gun remains unsupported and generally hangs down freely from the flexible hoses, that are supported on the dispensing system, towards the floor. The operator, therefore, must still exert considerable effort to manually weight support and manually maneuver the gun and attached hoses to the proper position over the work surface. Furthermore, properly aiming the gun of Braun, Jr. and manually holding the gun in the proper position during application would be expected to be difficult, since with the added flexibility, the bottom heavy gun would be expected to rotate downwardly, making nozzle control and proper positioning difficult.

What is needed is an improved apparatus for mixing and dispensing two-component reactive fluids that includes a gun which will both mix and dispense the fluids, which is less bulky and cumbersome than prior systems, which produces less waste and what little waste it produces is readily removed, which will bring the hand operated trigger closer to the outlet nozzle so that the operator can hold the gun closer to the point of application for better control of fluid placement, which is fully weight supported in an operative position and, consequently, has less total weight than prior systems for ease of use and reduction in the occurrences of operator fatigue and muscle strains, and which is pivoted at multiple locations for improved flexibility and maneuverability.

SUMMARY OF THE INVENTION

It is an object of this invention, therefore, to provide a new and improved two-component mixing and dispensing system including a fully mechanically weight-supported in a ready-to-use position and multiply pivoted mixing and dispensing gun.

It is another object of this invention to provide a mixing and dispensing gun that is fully mechanically weight supported in an operative position and balanced, in order to reduce the total weight of the gun and make the gun less cumbersome and easier to operate.

It is yet another object of this invention to provide a mixing and dispensing gun that passes two reactive fluids separately through the gun and has an elongated disposable static mixer placed on the outlet of the dispensing gun, in order to reduce the amount of mixed waste during start-up and shut-down, and eliminate essentially all solvent cleaning or base purging during shut-down, since the static mixer may be discarded after use.

It is still another object of this invention to provide a mixing and dispensing gun with a hand-held actuating trigger placed on the elongated end of the static mixer tube, in order to reduce the distance between the operator's hand that holds the hand trigger and the dispensing outlet nozzle for better control of fluid placement on the work surface.

It is still another object of this invention to provide a mixing and dispensing gun with reactive fluid feed lines and support lines being pivotally attached to the gun in multiple locations for improved flexibility and maneuverability and reduced line kinking.

In accomplishing these and other objects, the invention resides in a mixing and dispensing system for two chemically reactive fluids, which is characterized by: a pump means for supplying two chemically reactive fluids separately through two flexible hoses; an elongated pivoted arm for pivotally supporting the two flexible hoses above a generally horizontal plane with a front end of each of the flexible hoses hanging below the pivot arm, the pivoted arm being rotatable about a generally vertical pivot axis; a mixing and dispensing gun including a body having two spaced inlets on opposite sides of the gun body for separately receiving the two fluids from the two flexible hoses, and two spaced outlets on a front of the gun body for separately dispensing the two fluids from the gun, a dispensing valve in the gun body for controlling the flow of the two fluids out through the two outlets, with the front ends of the two flexible hoses being separately pivotally attached to the two spaced inlets with two swivel connectors having flow channels defined therein, the swivels being rotatable about a common generally horizontal pivot axis and in flow communication with the flexible hoses and spaced inlets in all rotative positions; a static mixer including an elongated mixing tube having an inlet at one end connected to the two outlets of the gun body and an dispensing outlet nozzle at the opposite elongated end, and stationary mixing elements disposed in the mixing tube; an actuating trigger positioned on the static mixing tube in close proximity to the dispensing nozzle outlet end of the mixing tube for actuating the dispensing valves in the gun body; and, means for weight supporting the body of the mixing and dispensing gun above a generally horizontal plane in an operative position, the weight support means extending from the pivoted, arm and being pivotally attached to the top of the gun body, with the support means including a swivel being rotatable about a generally vertical pivot axis, the pivot axis being substantially perpendicular to the common generally horizontal pivot axis of the swivel connectors.

The various objects, features and advantages of the invention will become more apparent from the following description.

BRIEF DESCRIPTION OF THE DRAWINGS

There are shown in the drawings certain exemplary embodiments of the invention as presently preferred. It should be understood that the invention is not limited to these embodiments and is capable of variation within the spirit and scope of the appended claims.

With this description of the invention, a detailed description follows with reference to the drawings, in which like reference numerals denote like elements, and in which.

DETAILED DESCRIPTION OF THE PREFERRED EMBODIMENTS OF THE INVENTION

Figure 1:
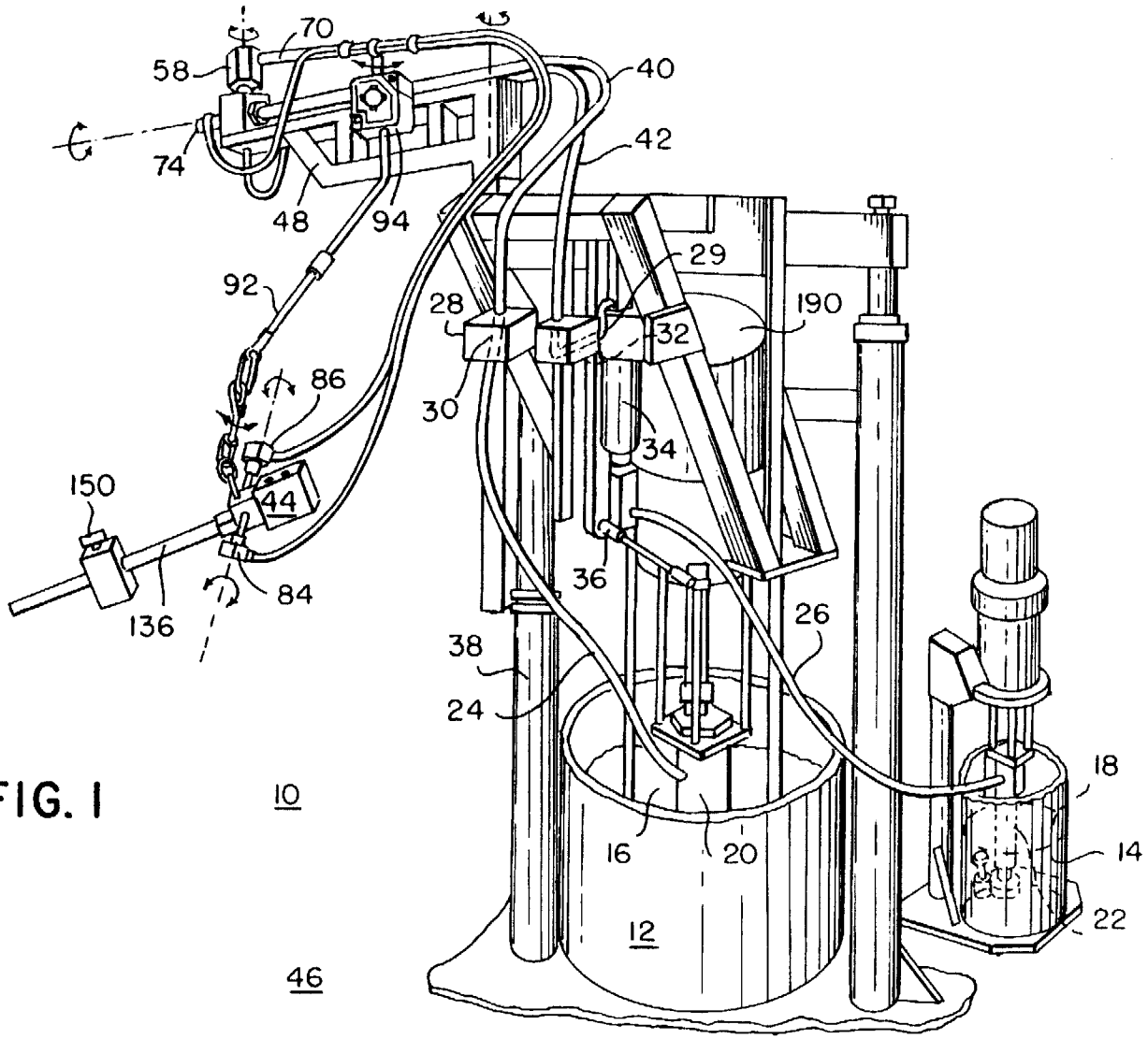
FIG. 1 is a perspective view of a mixing and dispensing system embodying the weight-supported, multi-pivoted mixing and dispensing gun of the present invention.

Referring to FIG. 1, the dispensing system embodying the invention is generally shown as 10 and includes supply vessels 12 and 14 respectively housing two chemically reactive fluids that need to be metered and mixed before dispensing, such as a polysulfide base resin 16 and a catalyst 18. The dispensing system 10 also includes pumps 20 and 22 for the resin and catalyst, respectively, such as positive displacement pumps operated with air motors driven by compressed air. The pumps 20 and 22 respectively direct the fluids from the supply vessels 12 and 14 through separate flexible hoses 24 and 26 to separate inlets of manifolds 28 and 29 which contain separate flow ports 30 and 32 (shown in phantom) for both the base resin and catalyst.

The catalyst hose 26, in particular, communicates with a standard metering cylinder 34, such as a positive displacement pump, prior to entering the catalyst inlet in the manifold 29. The metering cylinder 34 is used to provide the correct mix ratio of resin to catalyst flowing through the manifolds 28 and 29. As shown in FIG. 1, a cylinder linkage 36 is attached to both the resin pump 20 and the catalyst metering cylinder 34. Upon every stroke of the resin pump 20, the metering cylinder 34 pivots a set distance which draws a properly proportioned amount of catalyst into the catalyst port 32 in the manifold 29, as the desired amount of resin is simultaneously pumped separately into the resin port 30 in the manifold 28.

Flexible hoses 40 and 42 for the resin and catalyst, respectively, are separately attached to separate outlets in the manifolds 28 and 29. The flexible hoses 40 and 42 eventually direct the fluids individually to a mixing and dispensing gun 44.

Figure 2:
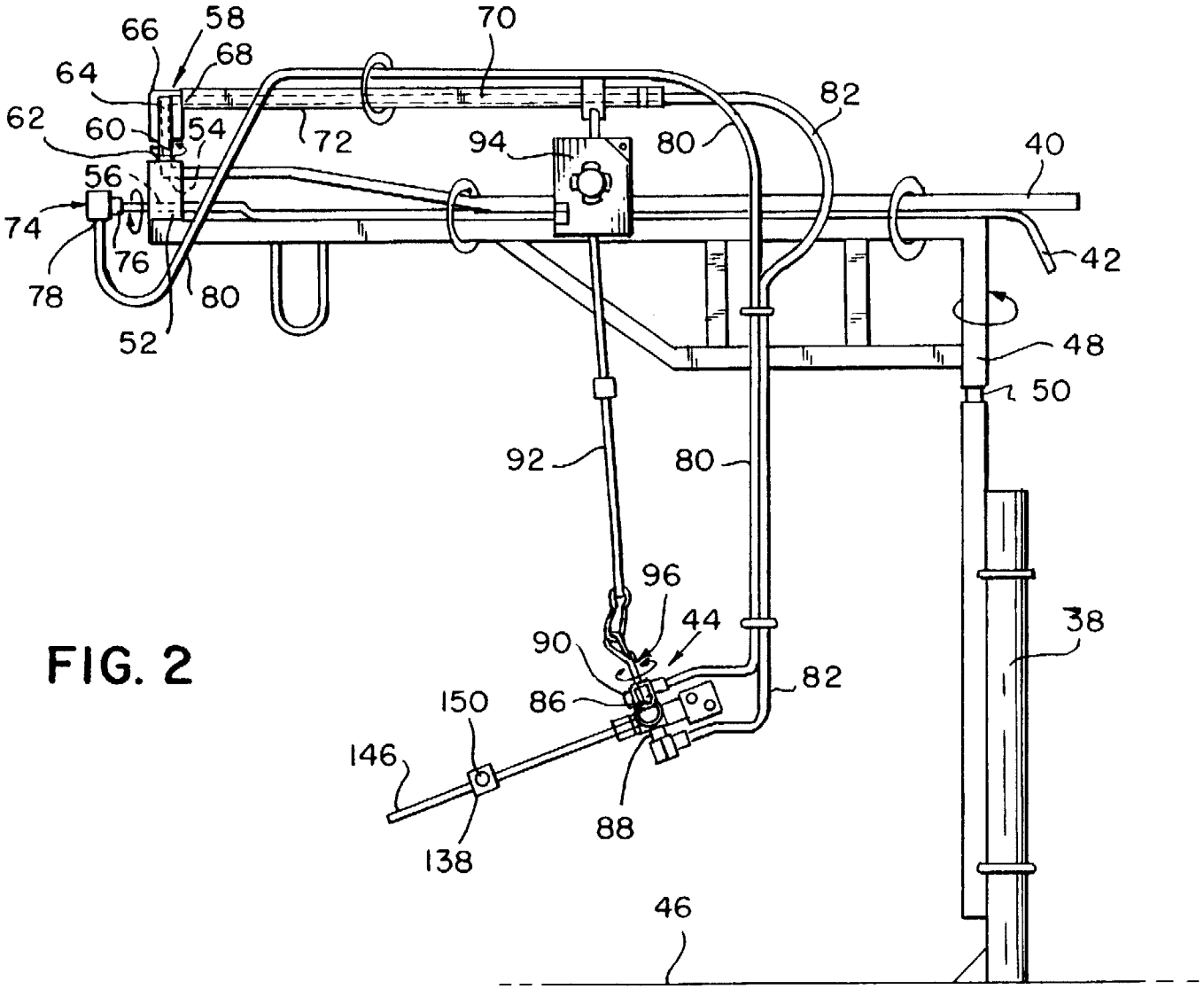
FIG. 2 is side view of the mixing and dispensing gun of the present invention, with the gun being tilted on its side for clarity.

Referring now to FIG. 2, the flexible hoses 40 and 42 are supported generally horizontally above the floor 46 on a pivoted arm or boom 48 that is rotatably attached by a pivot joint 50 to a ram post 38 associated with the resin pumping unit. The boom 48 is rotatable about a generally vertical pivot axis. The boom 48 extends outwardly a substantial radial distance from the ram post 38 and the resin pumping unit in order to provide enough clearance for an operator to adequately maneuver the dispensing gun 44.

The flexible hoses 40 and 42 resting upon the boom 48 are attached to a manifold block 52 mounted on top of the boom 48 generally at its outermost end. The manifold 52 includes separate flow ports 54 and 56 (shown in phantom) for the base resin and catalyst, respectively. The resin flow port 54 contains about a 90° upward bend, so that the resin is directed to exit at the top of the manifold 52. A standard swivel joint or swivel connector 58 is rotatably mounted around a generally vertical rotational axis to the outlet of the manifold resin port 54 at the top of the manifold 52.

Figure 4:
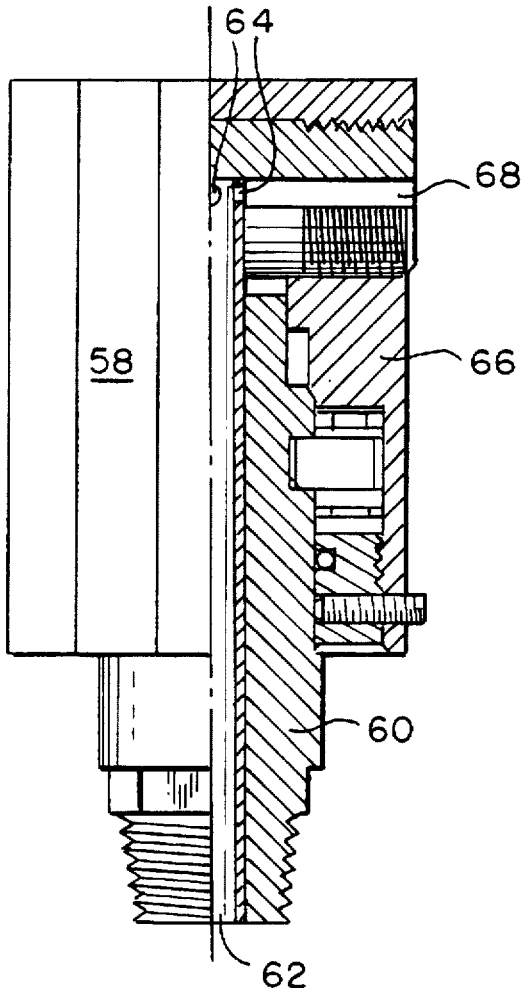
FIG. 4 is a side sectional view of an exemplary swivel connector that can be used to establish multiple pivotal flow connections in the mixing and dispensing gun of the present invention.

An exemplary swivel connector 58, as shown in partial section in FIGS. 2 and 4, generally includes an elongated cylindrical swivel tube 60 that is suitably connected to the outlet of the resin port 54. The tube 60 includes an inlet port 62 at the end connected to the resin port 54 and radial ports 64 disposed around the circumference of the tube at a selected distance along its length. The portion of the tube having the radial ports 64 is rotatably and sealingly housed in an outer swivel sleeve 66. The sleeve 66 generally surrounds the radial ports 64 and contains an outlet port 68, which is generally perpendicular to the inlet port 62 and alignable with at least one of the radial ports 64 in all rotative positions, thereby allowing open flow communication between the inlet port 62 and outlet port 68 when the swivel sleeve 66 is rotated in every pivotal position.

Referring again to FIG. 2, a generally horizontally elongated pivoted arm 70 having an internal resin port 72 (shown in phantom) extending therethrough is suitably connected to the outlet port 68 of the swivel connector 58. The pivoted arm 70 extends outwardly a shortened radial distance from the remote end of the boom 48 and is pivotal around the generally vertical swivel axis provided by the swivel connector 58, in order to allow the operator to further extend the dispensing gun 44 away from the resin ram post 38 and pumping units, providing additional room for the operator to maneuver the gun. It should be understood that the manifold and swivel connector may be arranged so that the pivoted arm is positioned below rather than above the boom to allow complete rotation of the pivoted arm about the pivot axis.

Suitably attached to the outlet of the catalyst port 56 which extends axially through the manifold 52 is a second swivel connector 74 having generally perpendicular inlet and outlet ports 76 and 78. The swivel connector 74 is pivotal around a generally horizontal rotational axis. The swivel connector 74, as shown, is generally of the same configuration as that of the aforesaid swivel connector 58. A flexible hose 80 for the catalyst is suitably connected to the outlet port 78 of the swivel connector 74 and is supported upon the pivoted arm 70 along its length. The swivel connector 74 prevents kinking of the catalyst hose 80 during rotation of the pivoted arm 70 as an operator positions the dispensing gun 44.

A flexible hose 82 for the resin is suitably connected to the resin outlet port on the outermost extension end of the pivoted arm 70. The flexible resin hose 82 and the flexible catalyst hose 80 hang freely down from the pivoted arm 70 towards the floor but preferably do not reach the floor. Each hose 82 and 80 is individually attached through swivel connectors 84 and 86, respectively, to separate resin and catalyst inlet ports 88 and 90 on opposite lateral sides of the dispensing gun 44. The swivel connectors 84 and 86 are generally of the same configuration as that of the aforementioned swivel connectors 58 and 74. The swivel connectors 84 and 86 are rotatable around a common generally horizontal rotational axis, which improves the pivoting of the dispensing gun 44 relative to the flexible hoses 80 and 82 and dramatically reduces the effort required to maneuver the gun.

The top portion of the dispensing gun 44 is suspended above the floor 46 with a tensioned line 92 that is used to counter balance and fully weight-support the dispensing gun 44 in an operative position above the floor 46, thereby eliminating the need for an operator to manually weight support a heavy and cumbersome dispensing gun. The tension and length of the line 92 can both be adjusted using a standard tool balancer 94 that is suitably mounted to the pivoted arm 70 and from which the line 92 extends. The tool balancer 94 is preferably mounted to the arm 70 such that it is pivotal up to about 30° from a generally vertical axis. The lower end of the balancer line 92 is looped and pivotally connected to the top of the dispensing gun 44.

Figure 5:
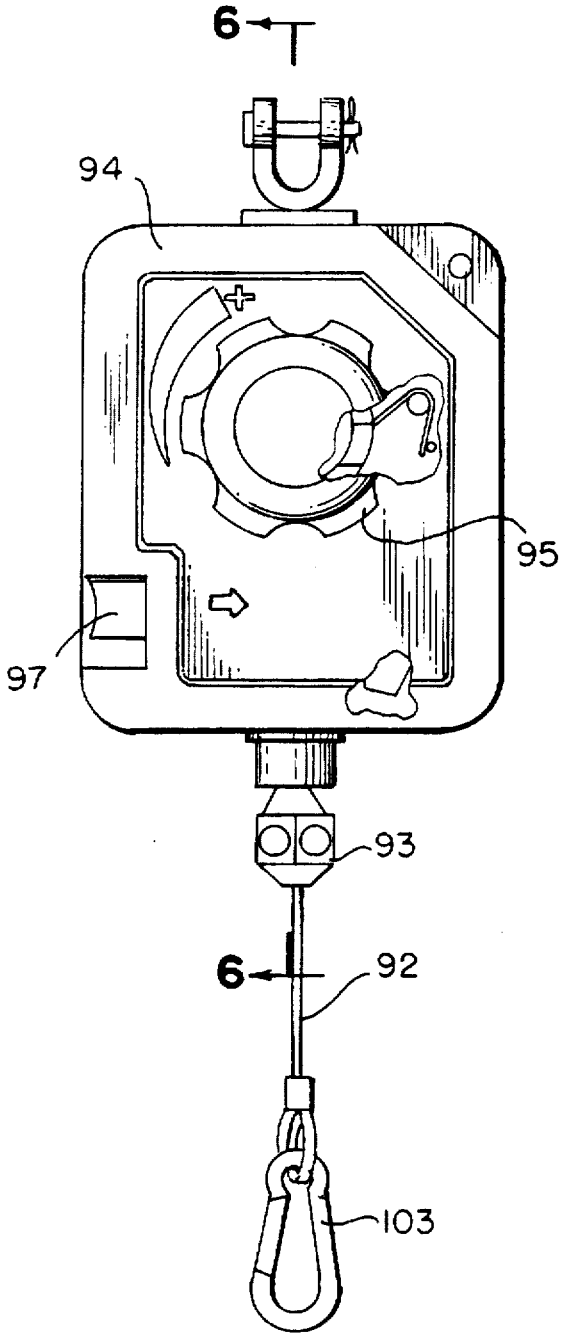
FIG. 5 is a front view, partly in section, of an exemplary balancer that can be used to weight support, in an operative position, the mixing and dispensing gun of the present invention.
Figure 6:
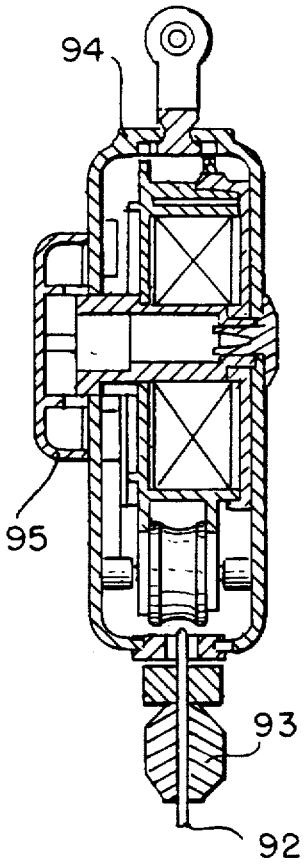
FIG. 6 is a side sectional view of the balancer of FIG. 5 taken along line 6—6.

Referring now to FIGS. 5 and 6, an exemplary tool balancer is shown. With this tool balancer, the amount of overhang of the line 92 can be adjusted in order to set the initial elevation of the gun 44 above the floor 46 by moving up and down a movable stop 93 that is releasably secured to the line 92. The line 92 is also spring tensioned to support the gun 44 at the selected elevation without having the line descend towards the floor from the weight of the gun. To adjust the line tension, a tension knob 95 is rotated in a clockwise direction which action tensions the main spring in the balancer. The balancer is also equipped with a tension release button 97 to selectively release tension in the line 92.

Referring again to FIG. 3, a snap swivel 96 is used to pivotally connect the top of the dispensing gun to the tool balancer line 92. The snap swivel includes an upper snap clip 98 and a lower ring 100. The snap clip 98 and ring 100 are rotatably connected together by a pivot connecting rod 102 and are rotatable around a generally vertical pivot axis. The upper snap clip 98 is connected to a tool clip ring 103 which is releasably attached to the looped end of the balancer line 92. The lower ring 100 is releasably attached to a hanger and plug combination 104 that is threadedly attached to the top of the dispensing gun 44. The pivot axis of the snap swivel 96 is arranged to be substantially perpendicular relative to the common swivel axis of the two swivel connectors 84 and 86 for three dimensional movement of the gun.

The dispensing gun 44 in the aforesaid arrangement is not only entirely weight-supported in an operative position, which allows the operator to maneuver the gun with very little effort, but also is adjustable in height and along multiple pivot axes to allow three dimensional pivoting of the gun for better control of fluid placement on the work surface and reduced line kinking. It should be understood that other methods may be used to weight support and balance the gun in an operative position as well, such as counterbalancing the gun with a spring supported on the pivoted arm and the like.

The dispensing gun 44 can be of any standard construction as is well known in the art for mixing and dispensing two-component reactive fluids. It is preferred that the gun allow for the separate components to be fed individually through the gun, passed separately through valved outlet ports that are controlled by an actuating trigger, and brought into contact with each other upon reaching an elongated mixing chamber attached to the valved outlet ports of the gun, with the mixing chamber having an outlet nozzle from which the mixed components are discharged. Although the dispensing gun will be described below with reference to a pneumatic or air actuated gun, the present invention is not limited to this exemplary embodiment.

Figure 3:
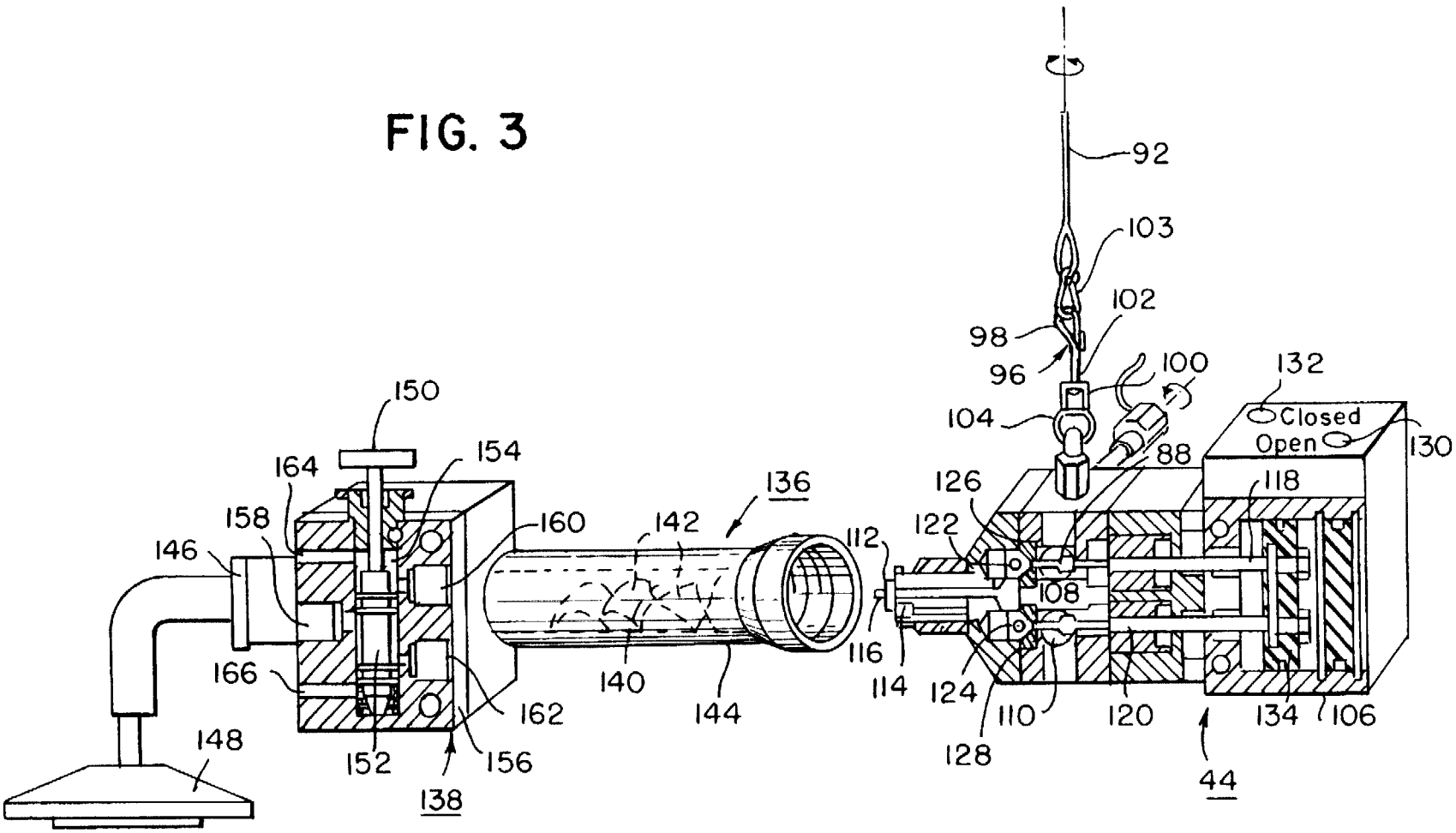
FIG. 3 is a fractional exploded view, partly in section, of the mixing and dispensing gun of the present invention.

Referring now to both FIGS. 2 and 3, an exemplary dispensing gun 44 as shown includes a generally rectangular body 106 having separate resin and catalyst inlet ports 88 and 90 on opposite sides of the body which, respectively, lead to separate elongated fluid passages 108 and 110 extending in the body. The two fluid components are passed separately along the passages 108 and 110 through two valved outlet ports 112 and 114 for controlling the dispensing of the two fluids separately through a divided outlet opening 116.

The dispensing valves controlling the valved outlet ports 112 and 114 can be of any standard construction as is well known in the art. The valves as shown are air trigger actuated valves and include interconnected movable valve needles 118 and 120 which in the normally closed position respectively urge snuff rings 122 and 124 against valve seats 126 and 128 in order to close the seats and prevent fluid flow past the valved outlet ports 112 and 114 and out through the divided outlet 116.

The movement of the valve needles 118 and 120 and, thus, the opening and closing of the valved outlet ports 112 and 114 are controlled by an air piston 134 driven by compressed air that is supplied into the body of the gun. The compressed air is directed into one of two air chambers 130 and 132 in the top rear of the gun body, which respectively control the opening and closing of the valved outlet ports. The open and close air chambers 130 and 132, respectively, are sealingly divided from one another with a movable air piston 134 which interconnects the valve needles 118 and 120. Air pressure directed against the head of the piston 134 in one of the chambers causes movement of the piston and the interconnected needles, consequently either opening or closing the valved outlet ports 112 and 114. When opened, the valve needles 118 and 120 allow for the flow of the respective fluids from their separate passages 108 and 110 through the divided outlet 116 in order to mix together in a standard motionless or static mixer 136 that is attached to the divided gun outlet.

The passage of air selectively into one of the two chambers 130 and 132 to cause the opening and closing of the air actuated valves is controlled by pivoting an actuating air trigger 138, as will be described more fully described hereinafter.

The static mixer 136 is threadedly attached to the divided outlet 116. The static mixer 136 includes an elongated spiral mixer tube 140 and running substantially the entire length of the spiral mixer tube 140 are spiral mixer elements 142. The spiral mixer elements 142 are composed of pairs of helical vanes spiraled in opposite directions about a common longitudinal axis along the length of the spiral mixer tube 140, as is well known in the art. The pattern of the spiral mixer elements allows homogeneous swirling and mixing of the resin and catalyst as they pass through the length of the spiral mixer tube 140. The static mixer 136 is removably housed in an elongated outer tubular jacket 144 that is threadedly attached to the divided outlet 116.

The static mixer 136, including the spiral mixer tube 140 and spiral mixer elements 142, is preferably molded of an inexpensive plastic material so that after dispensing, mixed and catalyzed resin need not be removed from the tube. Instead of rinsing with hazardous solvents or purging with costly unmixed base resin, the static mixer 136 is removed and set aside until the mixed material hardens within the mixer tube 140. After the material has set, the tube and static mixer pose no environmental hazard and can simply be thrown away after use, thereby eliminating solvent cleaning or base purging and the creation of costly and hazardous waste therefrom.

After passing through the static mixer 136, the mixed fluids are directed to an outlet nozzle 146 at the outermost end of the outer jacket 144. Dispensing tips 148 having the desired configuration for the particular application can be threadedly connected to the single outlet nozzle 146.

The dispensing gun is activated with a hand-held actuating air trigger 138 that communicates with a supply of compressed air from an air supply is mounted on the outlet end of the outer jacket 144. The air trigger 138 is positioned in close proximity to the outlet nozzle 146 and dispensing tip attachment 148 for better control of fluid placement by the operator. Rather than having the trigger positioned on the body of the gun 44 which is a substantial distance away from the outlet and dispensing tip, the hand operated trigger in the present invention is positioned closer to the outlet nozzle 146 and dispensing tip 148, which allows the operator to hold the gun closer to the point of application for better dispensing control. Less effort is, therefore, required to properly position and maintain the gun over the work surface.

The air trigger 138 can be made of any standard construction. As shown in FIG. 3, an exemplary air trigger 138 is a 4-way valve which includes a depressible finger button 150 connected to a spring biased valve stem 152 that is movably contained in a channel 154 formed in a trigger housing 156. The channel 154 is provided in flow communication with an air inlet port 158 on one side of the housing 156 and two spaced apart air outlet ports 160 and 162 on the opposite side. Depending on the position of the valve stem 152 in the channel, only one of the two outlets 160 and 162 at a time is in open flow communication with the air inlet port 158, with the other being sealed by spaced apart enlarged snuff rings on the valve stem. The air trigger 138 also includes two spaced exhaust ports 164 and 166 which are provided in flow communication with outlet ports 160 and 162, respectively, and serve to evacuate air from the outlet port that is in the sealed position.

Thus, when air is supplied from an air hose through the trigger inlet port 158, depending on the position of the trigger valve stem 152 through depression of the finger button 150, the air is directed to flow out one of the two outlet ports 160 and 162 and selectively into either the opened or closed air chambers 130 and 132 in the body of the gun, which are respectively connected to the outlet ports 160 and 162 of the air trigger with air hoses. It should be understood that other standard trigger controlled dispensing valves for the dispensing gun can be used as well, such as spring trigger actuated valves or electrical trigger actuated valves.

In a preferred embodiment of the present invention, it is desired to exhaust any volume of compressed air that is left in the gun after the air trigger is released when the operator wants to stop dispensing the mixed fluid from the gun. Exhausting of air from the body of the gun avoids static pressure builds in the air circuit and prevents surges and overruns of mixed fluid during start-up of the gun, which is undesirable.

Figure 7:
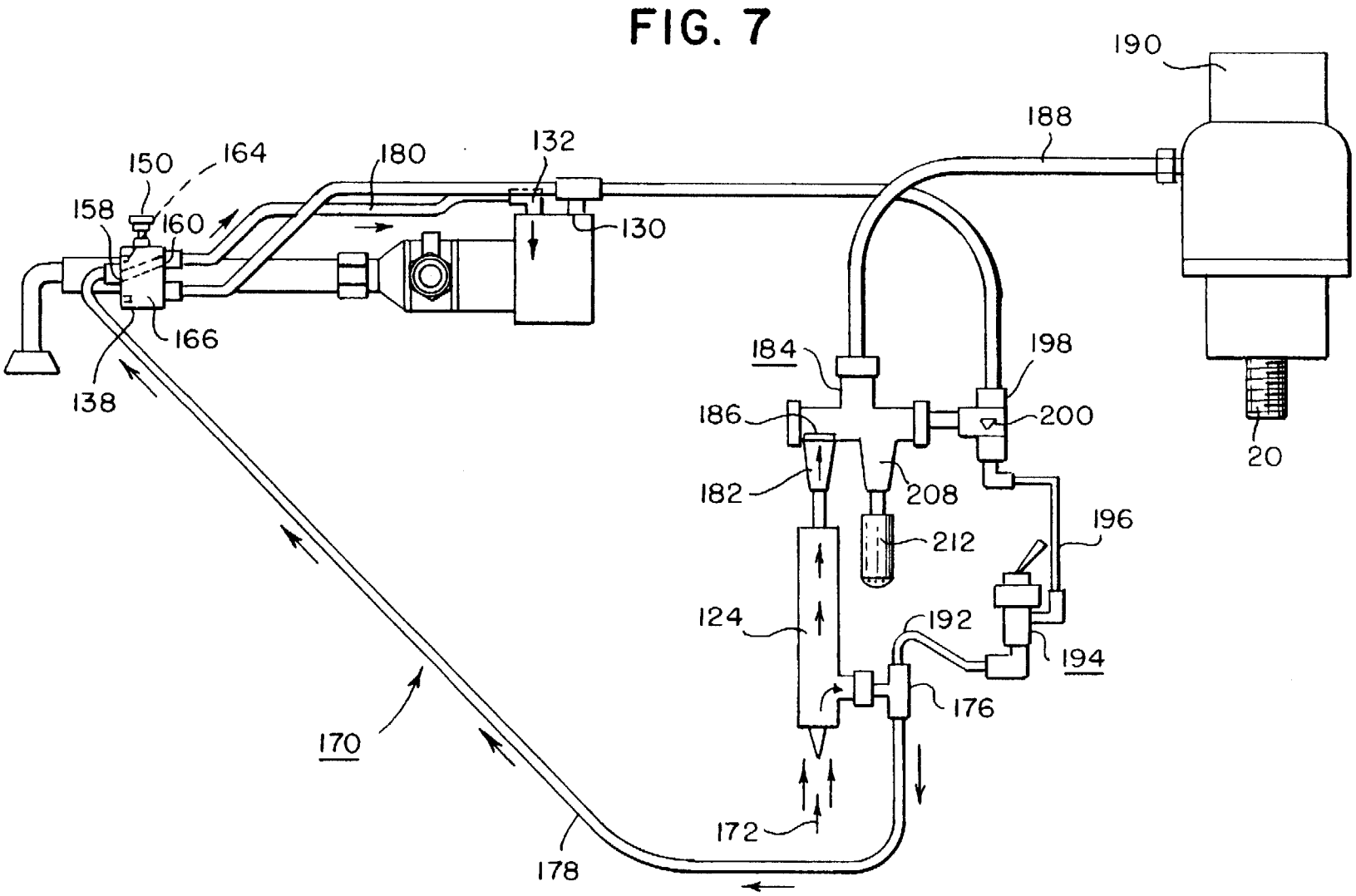
FIG. 7 is a schematic of an exemplary air flow circuit for deactivating the mixing and dispensing gun of the present invention; and, FIG. 8 is a schematic of an exemplary air flow circuit for activating the mixing and dispensing gun of the present invention.

Referring now to FIG. 7, a preferred air flow circuit 170 used for deactivating the plural component mixing and dispensing system of the present invention without static pressure build is shown. Arrows are used in FIG. 7 to indicate the direction of air flow through the circuit. Compressed air 172 enters a main air manifold 174 and flows out into a circuit tee fitting 176 attached to an outlet on the manifold. Air is directed from the circuit tee fitting 176 through an air hose 178 to the inlet 158 of the 4-way air trigger 138. The push button 150 on the air trigger is in the undepressed condition so as to allow unobstructed flow communication between the air inlet 158 and air outlet 160 in the trigger 138. The 4-way air trigger 138 sends the compressed air out of the air outlet 160 through an air hose 180 into the normally closed air inlet port 132 in the mixing and dispensing gun 44. The air acts against the air piston 134 and forces the valved outlet ports 112 and 114 in the gun body to remain in their normally closed positions, which deactivates the gun and stops the reactive fluids in the fluid passages 108 and 110 of the gun from exiting the divided gun outlet 116.

In the air flow circuit 170, while the mixing and dispensing gun 44 is deactivated, an exhaust cycle simultaneously occurs to stop the main air motor 190 that drives the base resin pump 20 and remove static pressure build from the air circuit. For this to occur, compressed air is also directed from the main air manifold 174 out into a valved port 182 of a standard pilot valve 184 that is attached to an outlet of the manifold 174. The valved port is normally closed by a valve 186, which stops the air from traveling through an air hose 188 into the master air motor 190 that is used to activate the base resin pump 20. Stoppage of compressed air to the air motor 190 causes the base resin pump 20 to stop and eliminates static pressure build in the fluid lines 80 and 82 to the dispensing gun 44.

Compressed air is also caused to exit the circuit tee fitting 176 through an air hose 192 into a standard air toggle 194 and its stop therein, since the air toggle is switched to its closed position. Air is, thus, not allowed to pass from the air toggle 194 through an air hose 196 into a standard shuttle valve 198, which air flow, if allowed, would shift the normally closed valve 200 in the shuttle valve 198 to an opened position and direct air into the pilot valve 184 to cause the opening of the normally closed valve 186 therein, so as to allow passage of air into the air motor 190 in the deactivated condition, which would cause a less desirable static pressure build up in the fluid lines.

Figure 8:
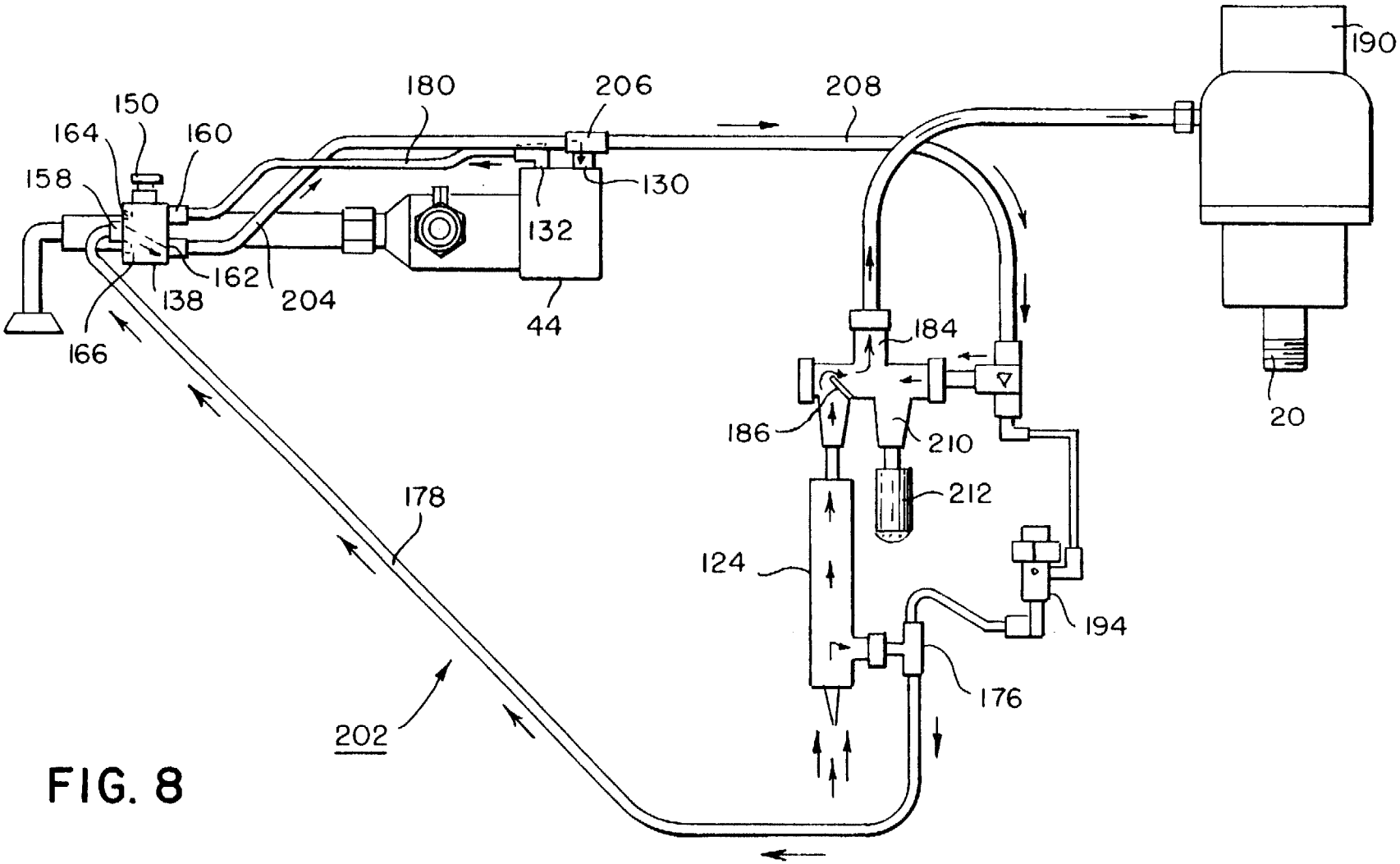

Referring now to FIG. 8, a preferred air flow circuit 202 used for activating the plural component mixing and dispensing system of the present invention is shown. Here again, arrows are used to indicate the direction of air flow through the circuit. When the push button finger trigger 150 is depressed, air is exhausted from air hose 180 through the air exhaust port 164 in the air trigger 138. Simultaneously, compressed air 172 continues to enter the main air manifold 174 and flows out into the circuit tee fitting 176. Air is directed from the circuit tee fitting 176 through the air hose 178 to the inlet 158 of the 4-way air trigger 138. The push button 150 on the air trigger is depressed, so as to allow unobstructed flow communication between the air inlet 158 and air outlet 162. The 4-way air trigger 138 sends the compressed air out of the air outlet 162 through an air hose 204 and through a tee fitting 206 and into the normally opened air inlet port 130 in the mixing and dispensing gun 44. The air acts against the air piston 134 and forces the valved outlet ports 112 and 114 in the gun body open, which activates the gun and starts the flow of reactive fluids through the gun passages 108 and 110 and causes the fluids to exit the divided gun outlet 116 into the static mixer 136 and out of the gun through the dispensing tip 148.

Compressed air is also directed out of the tee fitting 206 through an air hose 208 into the shuttle valve 198 and then into the pilot valve 184, which in turn, opens valve 186 and allows compressed air from the main air manifold 174 to feed the master air motor 190, sending the air motor and base resin pump 20 into motion and causing the fluids to be pumped through fluid lines 80 and 82 into the dispensing gun 44. The air toggle 194 again remains in the closed position.

When it is desired to stop dispensing the mixed fluids from the dispensing tip 148 of the mixing and dispensing gun 44, the push button 150 on the air trigger 138 is released. This causes the air flow pattern to revert back to that shown in FIG. 7. As the button 150 is released, air is exhausted from air hose line 204 through air the exhaust port 166 in the air trigger 138, and air is likewise exhausted from air hose line 188 through air exhaust port 210 and muffler 212 on the pilot valve 184, which eliminates static pressure build and fluid surges and overruns when the push button 150 is again depressed.

It should be understood that all individual parts used herein to form the weight-supported, multi-pivoted mixing and dispensing gun of the present invention are readily commercially available.

The advantages stemming from the present invention include, without limitation:

1. The dispensing gun is fully mechanically weight supported in an operative position and balanced, and, therefore, has less total weight and is less cumbersome to use.
2. The disposable static mixer placed after the separate flow dispensing gun reduces the amount of mixed waste during start-up and shut-down, and requires essentially no solvent cleaning or base purging during shut-down, since no mixed fluids ever pass through the dispensing gun and since the mixer containing the mixed waste may be simply discarded after use.
3. The actuating trigger placed on the dispensing end of the elongated static mixing tube reduces the distance between the hand held trigger and the dispensing outlet nozzle, allowing the operator to hold the gun closer to the dispensing outlet nozzle for better control of fluid placement on the work surface.
4. The dispensing gun and feed and support lines are pivoted in multiple locations for improved flexibility and maneuverability and reduced line kinking.

The U.S. patents mentioned throughout this specification are hereby incorporated by reference herein in their entireties.

The invention having been disclosed in the foregoing embodiments and examples, other embodiments of the invention will be apparent to persons skilled in the art. The invention is not intended to be limited to the embodiments and examples, which are considered to be exemplary only. Accordingly, reference should be made to the appended claims to assess the true spirit and scope of the invention, in which exclusive rights are claimed.

What is claimed is:

1. A mixing and dispensing system for two chemically reactive fluids, comprising:

pump means for separately dispensing two chemically reactive fluids from separate storage vessels through two separate flexible hoses;

support means for supporting said two flexible hoses above a generally horizontal plane having a front end of each of said two flexible hoses suspending below said support means;

a mixing and dispensing gun attached to said front ends of said two flexible hoses suspending from said support means, said mixing and dispensing gun including a body having two spaced inlets and outlets for separately receiving and dispensing said two fluids, and a dispensing valve means in said body for controlling said two fluids dispensed through said two outlets;

a motionless mixer including an elongated mixing tube having an inlet at one end connected to said two outlets of said gun body and a dispensing outlet nozzle at the opposite elongated end, and motionless mixing means disposed in said mixing tube;

an actuating trigger mounted on said mixing tube in close proximity to said dispensing outlet nozzle, said actuating trigger controlling said dispensing valves in said gun body; and, means for weight supporting said mixing and dispensing gun in an operative position above said generally horizontal plane, wherein said spaced inlets on said mixing and dispensing gun are disposed on opposite lateral sides of said gun body and said front ends of said flexible hoses are separately pivotally attached to said two spaced inlets with swivel means having internal flow channels, said swivel means being rotatable about a common generally horizontal pivot axis and in flow communication with said flexible hoses and said inlets in all rotative positions, and said weight supporting means for said mixing and dispensing gun comprises a balancing means attached to said support means, said balancing means having an adjustably elongated tensioned line attached to said gun body for counterbalance, said tensioned line being pivotally attached to a top of said gun body, said line being rotatable about a generally vertical pivot axis substantially perpendicular to said common generally horizontal pivot axis of said two swivel means connected to said two spaced gun inlets.

2. The mixing and dispensing system of claim 1, wherein:

said support means for said two flexible hoses comprises a generally horizontally elongated pivoted arm pivotally mounted on a support post, said pivoted arm being rotatable about a generally vertical pivot axis.

3. The mixing and dispensing system of claim 1, wherein:

said support means for said two flexible hoses comprises a first generally horizontally elongated pivoted arm having two ends, one end being pivotally mounted to a support post and the other end being free, said first pivoted arm being rotatable about a generally vertically pivot axis, and a second generally horizontally elongated pivoted arm pivotally mounted to said free end of said first pivoted arm, said second pivoted arm being rotatable about a generally vertical pivot axis, said flexible hoses resting on said first pivoted arm and then on said second pivoted arm, with said front end of said hoses suspending from said second pivoted arm below said support means.

4. The mixing and dispensing system of claim 1, wherein:

said motionless mixer is removably attached to said gun body and is disposable.

5. The mixing and dispensing system of claim 1, wherein:

said actuating trigger controls said dispensing valves with compressed air supplied from a compressed air supply.

6. The mixing and dispensing system of claim 5, wherein:

said actuating trigger comprises a push button trigger mounted atop said mixing tube.

7. The mixing and dispensing system of claim 5, wherein:

said actuating trigger further controls with said compressed air an air motor that drives said pump means, whereby upon release of said actuating trigger, said compressed air is diverted away from said air motor through an exhaust means to stop the air motor and avoid static pressure build up in said two flexible hoses.

8. A mixing and dispensing system for two chemically reactive fluids, comprising:

pump means for supplying two chemically reactive fluids separately through two flexible hoses;

an elongated pivoted arm for pivotally supporting said two flexible hoses above a generally horizontal plane with a front end of each of said flexible hoses hanging below said pivot arm, said pivoted arm being rotatable about a generally vertical pivot axis;

a mixing and dispensing gun including a body having two spaced inlets on opposite sides of said body for separately receiving said two fluids from said front ends of said two flexible hoses and two outlets at a front of said gun body for separately dispensing said two fluids from said gun, a dispensing valve in said gun body for controlling the flow of said two fluids out through said two outlets, said front ends of said two flexible hoses being separately pivotally attached to said two spaced inlets with two swivel connectors having flow channels defined therein, said swivels being rotatable about a common generally horizontal pivot axis and in flow communication with said flexible hoses and spaced inlets in all rotative positions;

a motionless mixer including an elongated mixing tube having an inlet at one end connected to said two outlets of said gun body and an dispensing outlet nozzle at said opposite end, and stationary mixing elements disposed in said mixing tube;

an actuating trigger positioned in close proximity to said dispensing nozzle outlet end of said mixing tube for actuating said dispensing valves in said gun body; and, means for weight supporting said body of said mixing and dispensing gun above a generally horizontal plane in an operative position, said weight support means extending from said pivoted arm and being pivotally attached to said top of said gun body, said support means including an adjustable line and a swivel attached to said line, said swivel being rotatable about a generally vertical pivot axis, said pivot axis being substantially perpendicular to said common pivot axis of said swivel connectors.

9. The system of claim 8, which further comprises:

each of said two flexible hoses being divided into two portions, a first portion extending from said pump means and a second portion with said front ends extending to said gun inlets;

a manifold mounted on an elongated end of said pivoted arm for joining said first and second hose portions together while pivotally suspending said second hose portions from said pivoted arm, said manifold having two spaced inlets on one side, said inlets separately receiving said two reactive fluids from said first portions of said two flexible hoses connected thereto, and two spaced outlets, one of said outlets being disposed on top of said manifold and the other of said outlets being disposed on an opposite side from said inlets;

a second elongated pivoted arm having a flow channel defined therein and an inlet and outlet at opposite ends, said inlet being pivotally mounted to said one of said two outlets on the top of said manifold with a third swivel connector, said second pivoted arm being rotatable about a generally vertical pivot axis and in flow communication with said manifold outlet in all rotative positions, said second pivoted arm outlet being connected to the second portion of one of the two flexible hoses with the front end thereof hanging down from said second pivoted arm; and, a fourth swivel connector having a flow channel defined therein and an inlet and outlet, said swivel connector inlet being pivotally mounted to the other of said two outlets of said manifold, said swivel connector being rotatable about a generally horizontal pivot axis and in flow communication with said manifold outlet in all rotative positions, said swivel connector outlet being connected to the second portion of the other of the two flexible hoses with the front end thereof hanging down from said second pivoted arm.

10. The system of claim 9, wherein:

said motionless mixer is removably attached to said two outlets of said gun body and is disposable.

11. The system of claim 9, wherein:

said actuating trigger comprises a push button trigger mounted atop said mixing tube.

12. A mixing and dispensing system for two chemically reactive fluids, comprising:

pump means for separately dispensing two chemically reactive fluids from separate storage vessels through two separate flexible hoses;

a pivotal support for supporting said two flexible hoses above a generally horizontal plane having a front end of each of said two flexible hoses suspending below said support;

a mixing and dispensing gun attached to said front ends of said two flexible hoses, said mixing and dispensing gun including a body having two spaced inlets and outlets for separately receiving and dispensing said two fluids, and a dispensing valve in said body for controlling said two fluids dispensed through said two outlets, said spaced inlets being disposed on opposite lateral sides of said gun body and said front ends of said flexible hoses being separately pivotally attached to said two spaced inlets respectively with first and second swivel connectors having internal flow channels, said first and second swivel connectors being rotatable about a common generally horizontal pivot axis and in flow communication with said flexible hoses and said inlets in all rotative positions;

a disposable motionless mixer including an elongated mixing tube having an inlet at one end removably connected to said two spaced outlets of said gun body and a dispensing outlet nozzle at the opposite end, and motionless mixing elements disposed within said mixing tube;

a push button actuating trigger mounted on top of said mixing tube in close proximity to said dispensing outlet nozzle, said actuating trigger controlling said dispensing valves in said gun body.

13. The mixing and dispensing system of claim 12, wherein:

said pivotal support for said two flexible hoses comprises a generally horizontally elongated pivot arm pivotally mounted on a support post, said pivot arm being rotatable about a generally vertical pivot axis.

14. The mixing and dispensing system of claim 13, wherein:

one of said two flexible hoses is pivotally suspended from said pivot arm with a third swivel connector rotatable about a generally horizontal pivot axis; and, the other of said two flexible hoses is pivotally suspended from said pivot arm with a fourth swivel connector rotatable about a generally vertical pivot axis.

15. The mixing and dispensing system of claim 14, further comprising:

a weight support for supporting said mixing and dispensing gun body in an operative position above said generally horizontal plane.

16. The mixing and dispensing system of claim 15, wherein:

said weight support for said mixing and dispensing gun comprises a balancer attached to said pivot arm, said balancer having an adjustably elongated tensioned line attached to said gun body for counterbalance, said balancer being pivotally attached to a top of said gun body, said line being rotatable about a generally vertical pivot axis substantially perpendicular to said common generally horizontal pivot axis of said two swivel connectors connected to said two spaced lateral gun inlets.

17. The mixing and dispensing system of claim 16, wherein:

said actuating trigger controls said dispensing valves with compressed air supplied from a compressed air supply.

18. The mixing and dispensing system of claim 17, wherein:

said two chemically reactive fluids comprise a two-component polysulfide sealant for insulating glass.

19. The mixing and dispensing system of claim 17, wherein:

said actuating trigger further controls with said compressed air an air motor that drives said pump means, whereby upon release of said actuating trigger, said compressed air is diverted away from said air motor through an exhaust means to stop the air motor and avoid static pressure build up in said two flexible hoses.

* * * * *

UNITED STATES PATENT AND TRADEMARK OFFICE

CERTIFICATE OF CORRECTION

PATENT NO. : 5,797,546

DATED : August 25, 1998

INVENTOR(S) : Reed et al.

It is certified that error appears in the above-identified patent and that said Letters Patent is hereby corrected as shown below:

Col. 14, Ln. 40 "claim 9" should read -- claim 8 --.

Signed and Sealed this

Tenth Day of August, 1999

*Attest:*

Q. TODD DICKINSON

*Attesting Officer*

*Acting Commissioner of Patents and Trademarks*